US009350066B2

(12) United States Patent
Moreau et al.

(10) Patent No.: US 9,350,066 B2
(45) Date of Patent: May 24, 2016

(54) ANTENNA UNIT

(71) Applicant: DASSAULT AVIATION, Paris (FR)

(72) Inventors: Jean-Patrick Moreau, Soisy Sur Seine (FR); Roland Carre, Le Chesnay (FR)

(73) Assignee: DASSAULT AVIATION, Paris (FR)

( * ) Notice: Subject to any disclaimer, the term of this patent is extended or adjusted under 35 U.S.C. 154(b) by 343 days.

(21) Appl. No.: 13/935,323

(22) Filed: Jul. 3, 2013

(65) Prior Publication Data

US 2014/0009353 A1 Jan. 9, 2014

(30) Foreign Application Priority Data

Jul. 5, 2012 (FR) ..... 12 01909

(51) Int. Cl.

| | |
|---|---|
| ***H01Q 1/24*** | (2006.01) |
| ***H01Q 1/00*** | (2006.01) |
| ***H01Q 1/28*** | (2006.01) |
| ***H01Q 1/50*** | (2006.01) |
| ***H01Q 21/00*** | (2006.01) |
| ***H01Q 13/10*** | (2006.01) |

(52) U.S. Cl.

CPC ..... *H01Q 1/002* (2013.01); *H01Q 1/281* (2013.01); *H01Q 1/50* (2013.01); *H01Q 13/10* (2013.01); *H01Q 21/005* (2013.01)

(58) Field of Classification Search

USPC ..... 343/770, 702

See application file for complete search history.

(56) References Cited

U.S. PATENT DOCUMENTS 6,198,445 B1 * 3/2001 Alt ..... H01Q 1/28 343/705
6,552,693 B1 * 4/2003 Leisten ..... H01Q 11/08 343/702

FOREIGN PATENT DOCUMENTS

| | | | |
|---|---|---|---|
| EP | 1117147 | A2 | 7/2001 |
| FR | 2675767 | A1 | 10/1992 |
| GB | 2295594 | A | 6/1996 |
| GB | 2474775 | A | 4/2011 |
| JP | 2002016420 | A | 1/2002 |

OTHER PUBLICATIONS

Search Report (INPI, French Patent Office); FR 1201909; Apr. 10, 2013.

* cited by examiner

*Primary Examiner* — Hoang V Nguyen
*Assistant Examiner* — Hai Tran
(74) *Attorney, Agent, or Firm* — Davidson, Davidson & Kappel, LLC

(57) ABSTRACT

This antenna unit comprises an antenna having a radiating front surface, a back surface and a lateral outline having at least one electric field reinforcing region. It is characterized in that it further comprises a device protecting the antenna from lightning, having an internal surface at least partially capping the lateral outline of said antenna by being in electrical contact with said lateral outline, said internal surface covering the or each electric field reinforcing region, said protecting device having a curved external surface opposite said internal surface.

14 Claims, 7 Drawing Sheets

ANTENNA UNIT

CROSS-REFERENCE TO RELATED APPLICATIONS

This application claims benefit of French patent application number 1201909, filed Jul. 5, 2012, which is herein incorporated by reference.

BACKGROUND OF THE INVENTION

1. Field of the Invention

This invention relates to an antenna unit comprising an antenna having a radiating front surface, a back surface, and a lateral outline having at least one electric field reinforcing region.

The invention is applicable in particular to an airborne radar antenna unit adapted for detecting and locating weather conditions.

2. Description of the Related Art

Aboard an aircraft, weather radars are accommodated in the front tip. They generally include a slot antenna, mobile in elevation and azimuth, so as to scan all of the space situated in front of the aircraft.

This antenna is covered by a radome forming the outer surface of the front tip of the aircraft, thereby providing the shape thereof. The radome is electromagnetically transparent so that the antenna can transmit and receive electromagnetic waves. The object of the radome is to protect the radar antenna especially from the direct effects of lightning. For this purpose, the radome includes conductive lightning arresting bands uniformly arranged on the surface thereof, so that in case of lightning on the front tip of the aircraft, the lightning current will evacuate through the bands in order to avoid lightning attachment to the antenna via the radome.

The slot antenna has a general disk shape and has on the lateral outline thereof a stepped profile. However, such steps have salient angles forming electric field reinforcing regions likely to cause peak effects. Indeed, the electric field around the antenna being at a maximum near such salient angles, the latter are likely to become lightning attachment points, and thus responsible for the antenna to be struck by lightning.

Lightning resistance of the front tip of the aircraft is subject both to the dielectric characteristics of the radome component material, the ensured minimum spacing between the antenna and the inner wall of the radome, independently of the position of the antenna, and the setup of lightning arresting bands distributed over the periphery of the radome.

In particular, ensuring minimum spacing between the antenna, which is metallic, and the inner wall of the radome allows for the electric field developing near the antenna under lightning conditions to be limited.

Rating of an aircraft in relation to direct lightning resistance is obtained by means of standardized tests. Once acquired, this rating is transferred from one aircraft to the next as long as the configuration of the aircraft with regard to lightning resistance remains unchanged, i.e. as long as the characteristics conditioning lightning resistance of the aircraft remain unchanged. However, as soon as any of such characteristics is modified, the lightning resistance of the front tip of the aircraft is modified. A new rating is then required which implies that all or some of the rating tests must be repeated.

In particular, the characteristics determining lightning resistance are dependent on the characteristics of the weather radar employed, especially the dimensions of the antenna, positioning thereof inside the radome, and scanning in space which has to be done by the antenna. However, such characteristics of the radar are not standardized and may be modified in order to improve the performance thereof. Namely, the position of the antenna can be advanced inside the radome, and/or the diameter thereof can be increased, thus increasing scanning amplitude.

Such modifications will lead to deterioration in lightning resistance of the front tip of the aircraft.

In order to maintain the same spacing between the antenna and the radome, so as to keep the rating achieved for the aircraft with regard to lightning resistance, it may be envisaged to shift the entire radar backward or increase the radome. However, such solutions are not always compatible with the geometry of the aircraft nose and the interior design thereof.

The increase of the radome's electric strength, which allows for dielectric resistance, and thus electric field resistance, to be improved, can also be envisaged. However, this approach implies an increase in the thickness of the radome, i.e. the mass thereof, and a decrease in radio performance resulting in a negative impact on the performance of the radar, and more generally speaking of the aircraft.

SUMMARY OF THE INVENTION

Thus, the objective of this invention is to provide an antenna unit reducing the risk of lightning attachment to the antenna of the weather radar without having to modify the geometry of the aircraft nose.

For this purpose, the object of this invention is a unit of the above-mentioned type, characterized in that it further comprises a device for protecting the antenna from lightning, having an internal surface at least partially capping the lateral outline of said antenna by being in electrical contact with said lateral outline, said internal surface covering the or each electric field reinforcing region, said protecting device having a curved external surface opposite said internal surface.

According to further aspects of this invention, the antenna unit comprises one or several of the following characteristics:

- said antenna is a disk-shaped planar antenna, said protecting device advantageously being ring-shaped;
- said electric field reinforcing region is an angular part of said lateral outline;
- said protecting device comprises a circumferential median portion placed opposite said lateral outline, and a back portion, arranged on the back of said back surface, said median and back portions forming a housing for receiving the antenna;
- said protecting device further comprises a holding flange, arranged on the front of the front surface of the antenna, said back portion and said holding flange gripping the antenna in said protecting device;
- said back portion includes a longitudinal bearing face against the back surface of the antenna, said median portion includes a transverse bearing face against said lateral outline, and said holding flange includes a holding face in surface bearing contact against the front surface of the antenna, said internal surface being formed by said longitudinal bearing face, said transverse bearing face, and said holding face;
- said holding flange is in electrical contact with at least part of the field reinforcing regions of said antenna;
- said protecting device includes a rigid body and a deformable fastening seal, partially interposed between said body and said antenna;
- said protecting device includes a rigid body made integrally, having an internal surface at least partially capping the lateral outline of said antenna by being in electrical contact with said lateral outline, said internal surface covering the or each electric field reinforcing region, said rigid body having a curved external surface opposite said internal surface, and said rigid body includes means for engaging said antenna into said rigid body;

said rigid body includes means for locking the position of said antenna with respect to said protecting device;

said protecting device has several elements assembled according to a radial plane of said antenna;

said protecting device has at least two elements assembled on either side of the lateral outline of the antenna;

said internal and external annular surfaces are electrically conductive, advantageously metal-coated;

said protecting device is formed of an electrically insulating material at least partially covered with a metal coating;

said antenna has a plurality of slots.

According to one embodiment, the antenna of the unit is an antenna of a weather radar, arranged in the front tip of the aircraft.

Another object of this invention is an aircraft comprising an antenna unit according to the invention.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
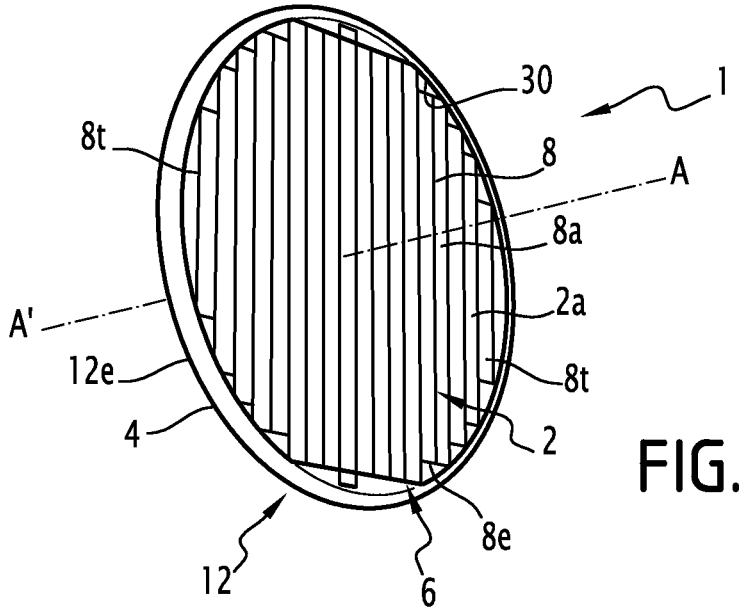
FIG. 1 is a schematic perspective view of a first embodiment of an antenna unit according to the invention.

In FIG. 1, an antenna unit 1 according to a first embodiment of this invention is shown. Unit 1 is to be positioned in the front tip of an aircraft, and covered by a radome (not shown) forming the outer surface of the front tip.

Antenna unit 1 includes an antenna 2 and a device 4 for protecting the antenna 2.

In this example, antenna 2 is a planar metallic antenna having a plurality of slots. Such an antenna is generally designated by the term "slot antenna". Antenna 2 includes a substantially planar front radiating surface 2*a* to be oriented toward the outside of the aircraft, through the radome. Antenna 2 also includes a planar back surface 2*b*.

Throughout the following, the orientations chosen are provided for reference and understood with respect to the figures. In particular, the terms "front" and "back" are to be understood relatively with respect to the transmitting direction of the antenna.

Furthermore, in the course of the description, a front or back plane of the antenna will designate a plane comprising respectively the front surface 2*a* or the back surface 2*b* of the antenna 2, and the terms "inner" and "outer", when applied to a surface, are to be understood respectively as a peripheral surface oriented toward the axis A-A' passing through the center of antenna 2 orthogonally to the antenna, and a peripheral surface oriented opposite axis A-A'.

Moreover, a plane or section in parallel to the center plane of the antenna will further be designated as "longitudinal", a plane or section orthogonal to the center plane of the antenna will be designated as "transverse", and a transverse plane or axis including axis A-A' will be designated as "radial".

Antenna 2 includes an array 6 of radiating elements 8. Each radiating element 8 has the shape of a tube having a rectangular cross-section, closed at the ends, forming a waveguide.

Thus, each radiating element 8 includes a front wall 8*a*, forming a portion of the front surface 2*a* of the antenna, a back wall 8*b*, two sides extending between the front 8*a* and back 8*b* walls, not visible in the figures, and two end walls 8*e*. Each radiating element 8 is provided on the front wall 8*a* thereof with radiating sources, such as slots, not shown.

The radiating elements 8 have varying lengths. They are contiguous by the sides thereof, aligning their respective centers along the same longitudinal direction, between two terminal radiating elements 8*t*, so as to form the array 6. Thus, antenna 2 has a thickness e defined as the thickness of the radiating elements 8 in a transverse direction.

In a known manner, the radiating elements 8 are adapted so as to form together a consistent electromagnetic field the direction of propagation of which is perpendicular to the transmission surface.

As illustrated in FIG. 1, the lengths of the radiating elements 8 are such that antenna 2 is generally disk-shaped.

The front 2*a* and back 2*b* surfaces are respectively formed by the front 8*a* and back 8*b* walls of the radiating elements 8. Furthermore, the end walls 8*e* of the radiating elements and the sides of the terminal radiating elements 8*t* oriented toward the outside of the antenna 2 form a lateral outline 2*c* of the antenna 2.

Due to the box shape of the radiating elements 8, the lateral outline 2*c* of antenna 2 has at least one angular region. In this example, the lateral outline 2*c* is notched, in the shape of "steps". Namely, the front surface 2*a* of antenna 2 includes a plurality of salient angles formed by the corners 9 of the front wall 8*a* of at least part of the radiating elements 8, and the lateral outline of antenna 2 includes a plurality of ridges 10 projecting toward the back of the antenna 2 from the corners 9. The corners 9 and the ridges 10 form electric field reinforcing regions likely to cause peak effects.

By way of example, the diameter of the antenna 2 is comprised between 15 and 22 inches, and the thickness e is less than 12 mm.

Protecting device 4 is adapted to reduce the electric field at the periphery of antenna 2 by removing the electric field reinforcing regions due to corners 9 and ridges 10.

In this example, it includes a protecting ring 12, also called a corona ring or bending ring, having a general toroid shape. The ring has an internal surface 12*i*, oriented toward the antenna 2, and an external surface 12*e*.

Ring 12 is arranged around the antenna 2, the internal surface 12*i* being in electrical contact with the antenna 2. External surface 12*e* is wide and rounded. Thus, it is devoid of reinforcing regions likely to cause peak effects. The internal and external surfaces are metallic.

With the antenna unit according to the invention, the electric field reinforcing regions existing on the antenna due to the design thereof are thus "hidden" by the protecting device 4. In case of lightning, the risk that it will strike any of the field reinforcing regions of the antenna 2 is thus reduced to almost zero.

The protecting device 4 also includes a deformable flexible seal 14 (visible in FIG. 2), interposed between ring 12 and antenna 2, and intended to ensure contact between ring 12 and antenna 2.

Figure 2:
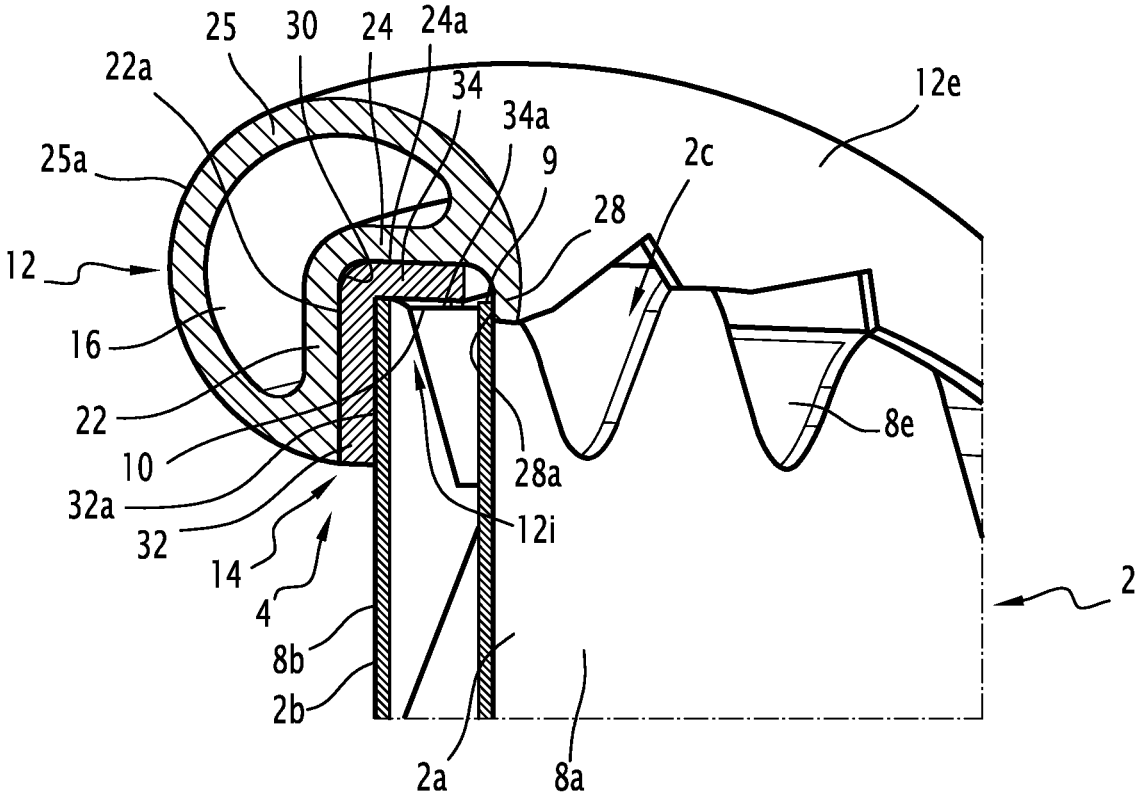
FIG. 2 is a schematic perspective view, in radial section, of a relevant part of the unit of FIG. 1.
Figure 3:
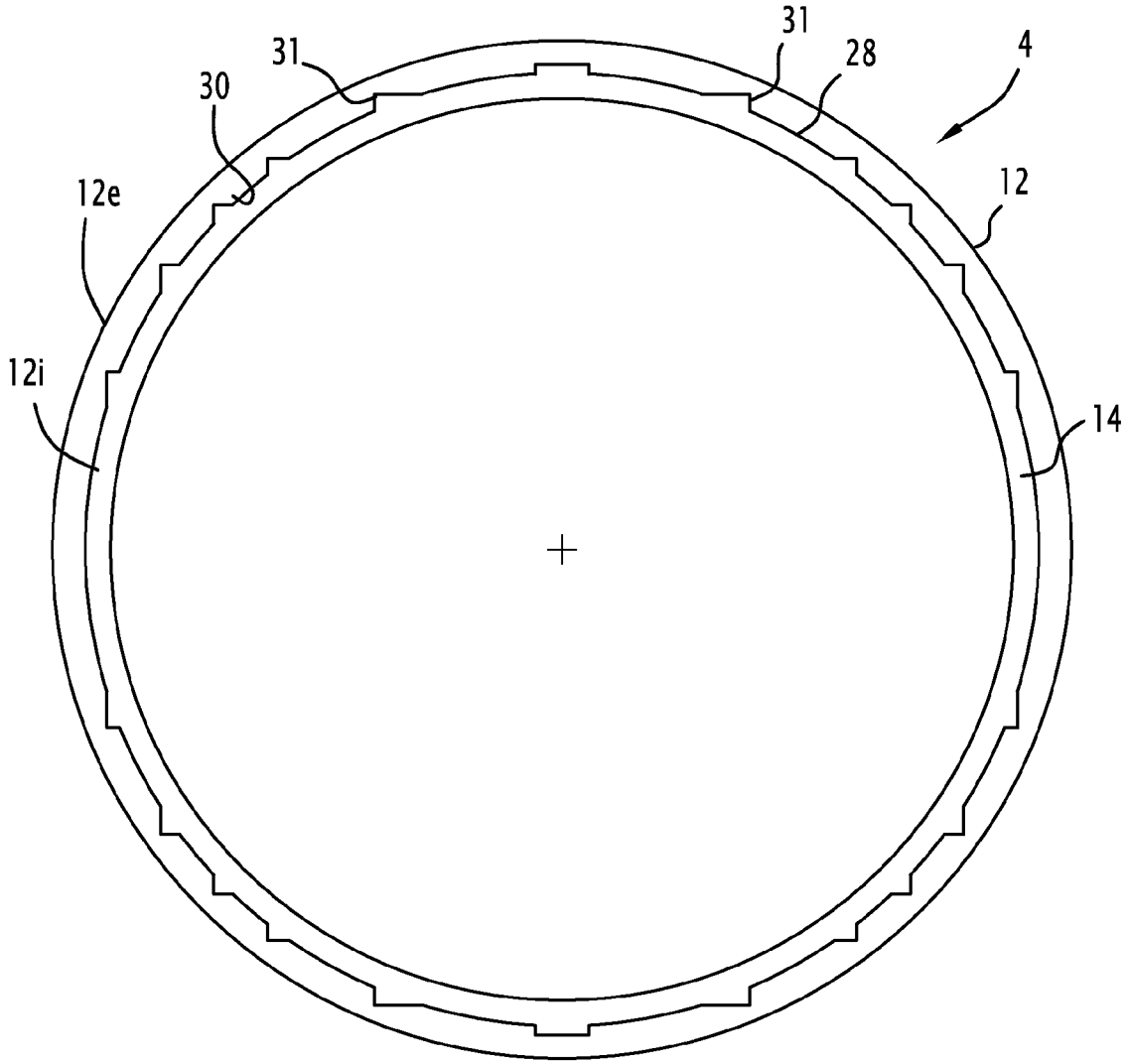
FIG. 3 is a schematic front view of the protecting device of the unit of FIG. 1.
Figure 4:
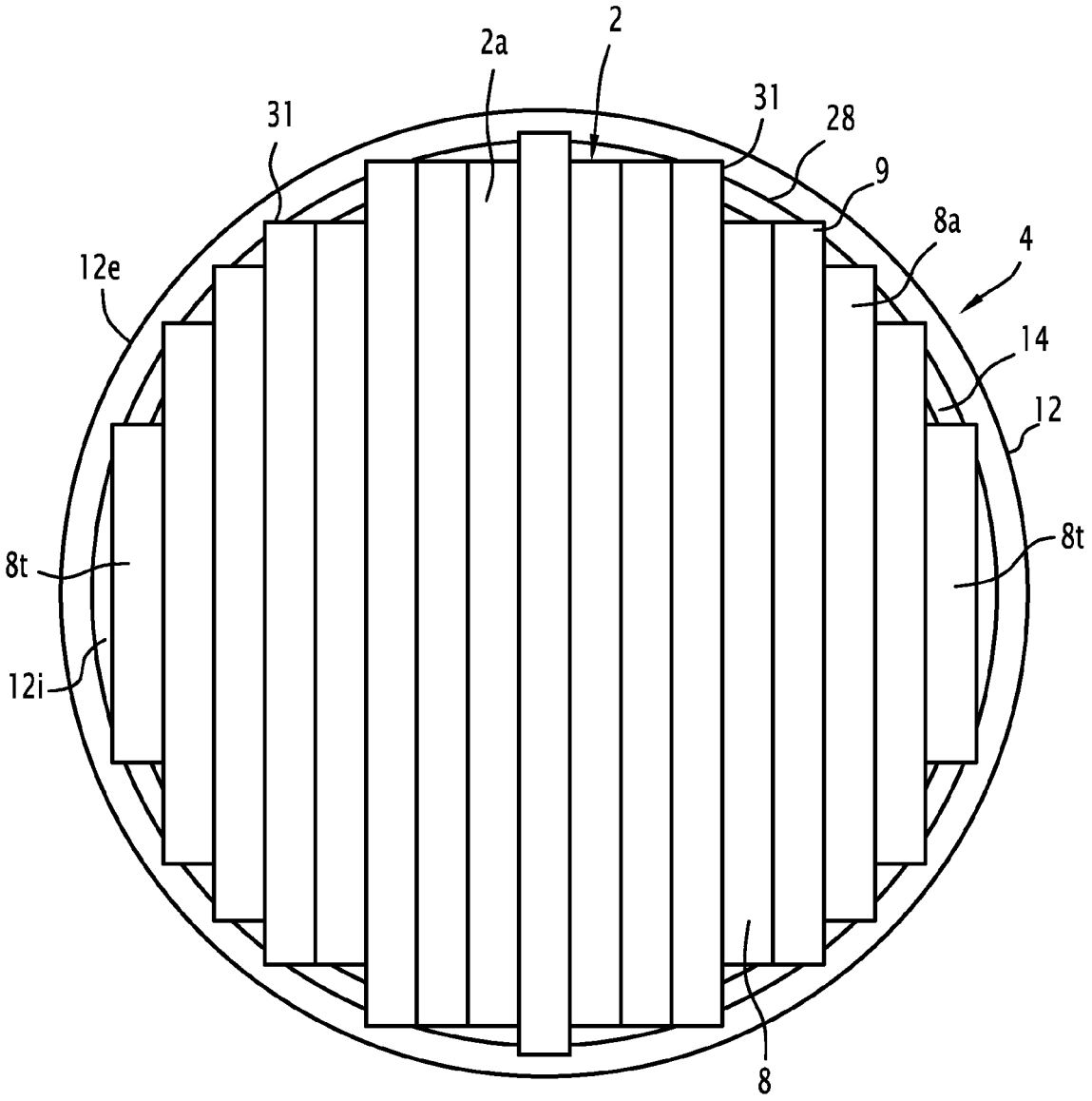
FIG. 4 is a schematic front view of the unit of FIG. 1 during installation.
Figure 5:
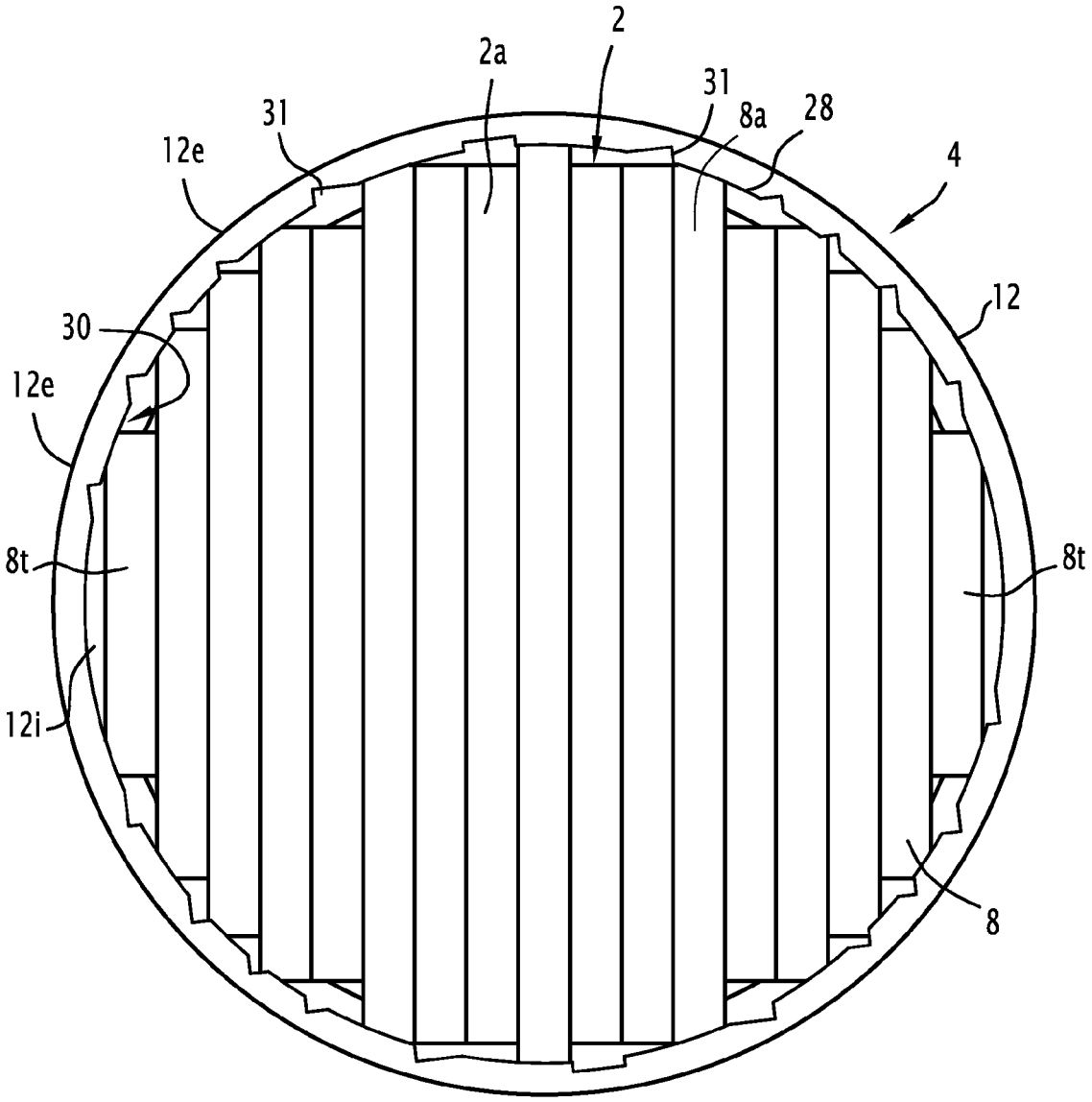
FIG. 5 is a schematic front view of the unit of FIG. 1 when installation is completed.

As illustrated in FIG. 2, ring 12 has a general revolving shape around the axis A-A'. Thus, it has a longitudinal section having a generally circular shape.

Ring 12 forms a hollow tube 16 wound around the axis A-A'.

Ring 12 includes a ring-shaped planar front longitudinal wall 22 and an annular transverse wall 24, advantageously orthogonal to the longitudinal wall 22 and arranged at right angles from the lateral outline 2*c* of antenna 2. Ring 12 further includes a back wall 25 having a radial section of curved shape, e.g. circular arc-shaped, extending between an inner flange of the longitudinal wall 22 and a front flange of the transverse wall 24. Advantageously, this circular arc forms an angle greater than or equal to 270°. The radial sections of the longitudinal 22 and transverse 24 walls form the radiuses of the circular arc, for example.

The tube 16 is thus defined by the longitudinal wall 22, the transverse wall 24, and the back wall 25.

The longitudinal 22 and transverse 24 walls include a longitudinal 22*a* and a transverse 24*a* bearing face, respectively, oriented toward the outside of the tube 16. The back wall 25 has an external face 25*a*, i.e. oriented toward the outside of the tube 16 forming the external surface 12*e* of the ring 12.

The external surface 12*e* is generally continuous, convex, curved, and devoid of macroscopic asperities. Thus, it is substantially devoid of electric field reinforcing regions.

Ring 12 further has a flange 28 for holding the antenna 2, having a general revolving shape around axis AA', projecting from the connecting region of the back wall 25 to the transverse wall 24, orthogonally to the transverse wall 24, toward the center of antenna 2. The flange 28 has a holding face 28*a* oriented toward the inside of the tube 16, opposite the bearing face 22*a*.

The longitudinal wall 22, the transverse wall 24, and the holding flange 28 thus define a housing receiving the antenna 2. In particular, the longitudinal wall 22 and the transverse wall 24 form a bracket 30 receiving the antenna 2, while flange 28 forms a member retaining the antenna 2 inside the bracket 30. The longitudinal 22*a* and transverse 24*a* bearing surfaces and the holding surface 28*a* form the internal surface 12*i* of the ring 12.

Thus, ring 12 has a median portion, surrounding the antenna 2 at right angles from the lateral outline 2*c* thereof, and a back portion, arranged on the back of the antenna, opposite the back surface 2*b*.

Ring 12 has an internal radius $R_{12}$, defined as the distance between axis A-A' and surface 24*a* of the transverse wall 24, slightly greater than radius $R_2$ of antenna 2, i.e. radius $R_2$ of a circle circumscribing the antenna 2.

Radius $R_{16}$ of tube 16 is greater than the thickness e of the antenna. This radius $R_{16}$ is for instance comprised between 1.2 and 3 times the thickness e of the antenna, advantageously 10 mm.

Ring 12 is made of a light-weight and rigid material, having a metallic outer surface. Advantageously, in view of mass gain, the ring 12 is made of a body formed of an insulating material, e.g. a plastic material covered with a metallic layer, e.g. of nickel, chrome, aluminum, or tin. The insulating body is for instance made by stereolithography, while the metal layer is for instance deposited by electroplated coating, or sputtering or vapor deposition.

The flexible seal 14, having a general revolving shape around a center axis AA', has an L-shaped radial section. Thus, the flexible seal 14 includes a longitudinal branch 32 and a transverse branch 34. The external surface thereof has a shape matching the surface of bracket 30 formed by the bearing surfaces 22*a*, 24*a*. Thus, the flexible seal 14 is arranged in surface bearing contact against the external surface of the bracket 30, the external surfaces of the longitudinal 32 and transverse 34 branches being placed in surface bearing contact against the external bearing surfaces 22*a* and 24*a*, respectively.

Advantageously, the thickness of the transverse branch 34 of the seal 14 is substantially equal to the difference between the radius $R_2$ of the antenna and the radius $R_{12}$ of the ring. Also, the thickness of the longitudinal branch 32 of the seal 14 is substantially equal to the difference between the radius $R_{16}$ of the tube 16 and the thickness e of the antenna 2. The longitudinal 32 and transverse 34 branches advantageously have the same thickness. The seal 14 is made of an insulating flexible material, e.g. based on silicone or elastomer. The longitudinal 32*a* and transverse 34*a* internal surfaces of the seal 14 as well as the surface 28*a* of the holding flange 28 are bearing against the antenna 2.

Ring 12 is advantageously made integrally. The holding flange 28 includes a plurality of notches 31, intended to allow for the antenna 2 to be engaged into the bracket 30. In particular, each of the notches 31 is adapted for receiving one of the corners 9 of the antenna 2 when it is engaged into the ring 12 according to a direction in parallel to axis A-A'.

Moreover, the ring 12 includes means for locking the angular position of the antenna 2 (not visible in the figures), adapted to block the antenna 2 inside the ring 12 in rotation around axis A-A', after engagement thereof into the ring 12. Such locking means include for instance a plurality of stops projecting into the bracket 30.

As represented in FIGS. 3 to 6, the antenna 2 is installed in the device 4 by engaging the antenna 2, in parallel to axis A-A', into the bracket 30, each corner 9 of the antenna 2 being received in a notch 31. The device 4 is then turned around axis A-A' into a stop position, where the antenna 2 is blocked in rotation inside the ring 12 by the locking means.

In this stop position, the corners 9 are in surface bearing contact against the surface 28*a* of the holding flange 28, and covered by flange 28. Each notch 31 is then substantially at the same distance from both adjacent corners 9 of the antenna 2.

The protecting device 4 formed by the ring 12 and seal 14 is thus arranged around the antenna 2, contacting each of the projecting ridges 10 of the antenna 2.

In particular, each of the projecting ridges 10 is bearing against the transverse internal surface 34*a*, and the longitudinal internal surface 32*a* receives in surface bearing contact an annular outer portion of the back surface 2*b* of the antenna 2.

Antenna 2 is thus held in a fixed position inside the ring 12 by the longitudinal 22 and transverse 24 walls, and the holding flange 28. Namely, the longitudinal wall 22 and the holding flange 28 form a vise preventing movement of the antenna 2 with respect to the ring 12 in a transverse direction. Thus, the flexible seal 14 allows for the ring 12 to be made integral with the antenna 2, avoiding any movement of one with respect to the other, namely in flight. Furthermore, antenna 2 is blocked in rotation around axis A-A' by the locking means.

Equipotentializing of the antenna 2 and the ring 12 is ensured by the electrical contact existing between the holding flange 28 and the corners 9 of the antenna 2. Maintaining the antenna 2 and the ring 12 at the same potential allows for current flows therebetween to be eliminated and the causes for triggering lightning to be limited.

Figure 6:
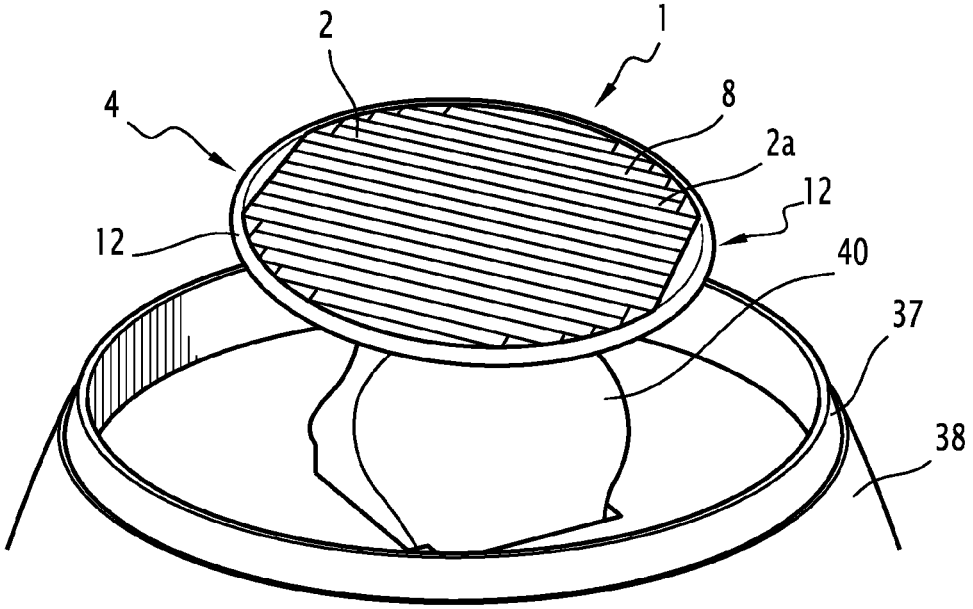
FIG. 6 is a schematic perspective view of an aircraft the front tip of which is provided with the unit of FIG. 1 and where the radome is not represented.

As apparent in FIG. 6, the antenna unit 1 is movably installed in the front tip 37 of an aircraft 38 by being mounted on a scanning device 40. In the nominal position of the antenna unit 1, the front plane of the antenna 2 is orthogonal to the roll axis of the aircraft 38. The longitudinal direction of the radiating elements 8 is for instance turned by 45° with respect to a vertical axis.

The device 40 is adapted for turning the antenna unit 1 around two orthogonal axes going through the center of the antenna 2, and respectively parallel to the yaw axis and pitch axis of the aircraft 38. Antenna unit 1 is thus mobile both in elevation and azimuth. By way of example, the antenna unit 1 can scan an angle of 120° in azimuth and 70° in elevation around the nominal position thereof.

E.g., ring 12 is made by assembling two ring halves having a longitudinal section with a generally semicircular shape around the antenna 2, according to a radial plan of the antenna 2.

Figure 7:
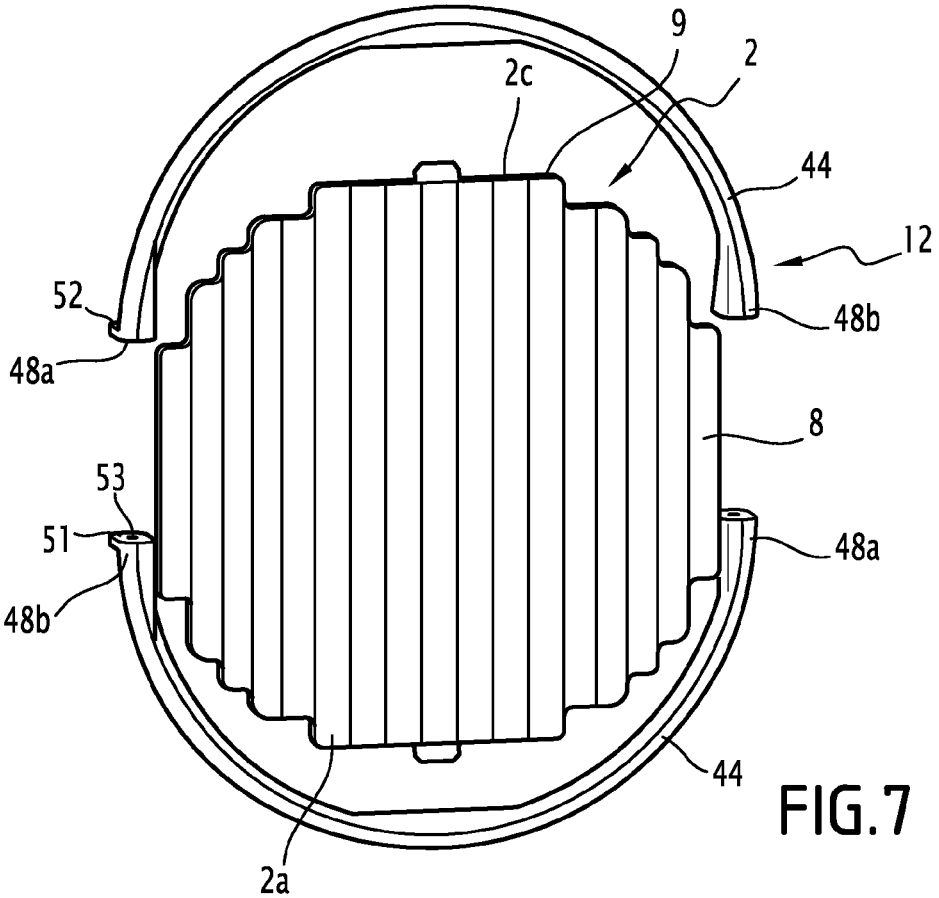
FIG. 7 is an exploded view of a second embodiment of an antenna unit according to the invention.

Thus, in FIG. 7, another embodiment of the ring 12 is represented.

In this embodiment, the ring 12 is made from two substantially identical ring halves 44 or 44', each ring half being adapted for surrounding the antenna 2 on one half of the periphery thereof, i.e. over an angular sector equal to 180°. Ring 12 is thus mounted by mechanically assembling the ring halves around the antenna 2 by assembling the respective ends. In this embodiment, the ring 12 is devoid of notches 31.

In the example illustrated in FIG. 7, this assembly is made by screwing. According to this embodiment, each ring half 44 includes two connecting ends 48*a* and 48*b*, each end 48*a*, 48*b* of one ring half 44 being adapted to be fastened by screwing to a corresponding end 48*b*, 48*a* of the other ring half 44.

Each connecting end 48*a*, 48*b* of the two ring halves 44 has a solid cross-section, expanded toward the inside and toward the back of the ring 2, and is closed by a planar radial terminal surface 51. Here, each terminal surface 51 forms a radial shoulder 52 perforated by a threaded hole 53.

Each end 48*a*, 48*b* of one ring half 44 is screwed to the corresponding end 48*b*, 48*a* of the other ring half 44 by means of a nut through the threaded holes 53.

Figure 8:
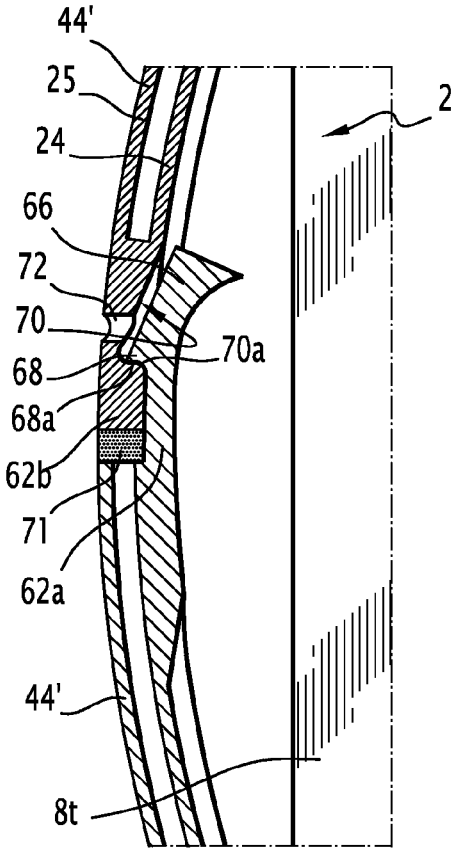
FIG. 8 is a view taken in longitudinal section of a variant of the second embodiment of the antenna unit.
Figure 9:
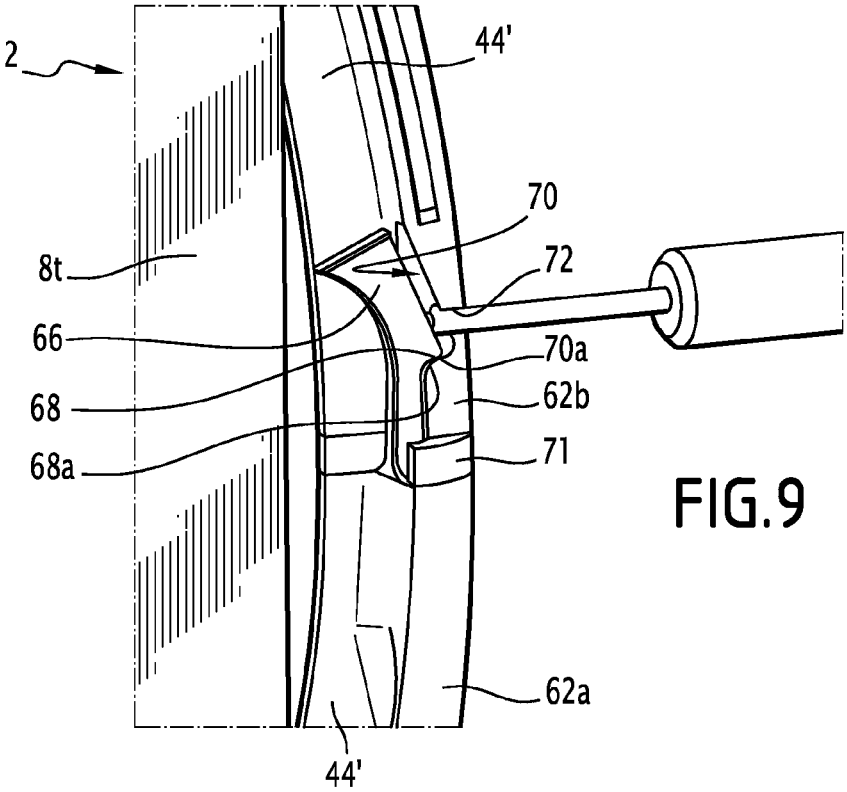
FIG. 9 is a perspective view partially in longitudinal section of the system of FIG. 8.

In a variant of this embodiment illustrated in FIGS. 8 and 9, the assembly between the ring halves 44' is made by clip-fastening. Thus, each ring half 44' includes two connecting ends 62*a*, 62*b*, each end 62*a*, 62*b* of one ring half 44' being adapted to be fastened by clip-fastening to the corresponding end 62*b*, 62*a* of the other ring half 44'.

In FIG. 8, only the region of the device located near a connecting region between the connecting ends 62*a*, 62*b* fastened to one another of the ring halves 44' is represented. Both connecting ends are fastened the one another by means of a snap-on assembly, comprising a locking tab and a corresponding locking opening.

The connecting end 62*b* thus includes a locking tab 66 projecting from the end edge of the transverse supporting wall 24 in a direction substantially in parallel to this wall. The tab 66 is elastically deformable. It includes on the outer surface thereof a stop projection 68 forming a radial shoulder 68*a* oriented toward the transverse supporting wall 24.

The connecting end 62*a* is adapted to be assembled by clip-fastening to the connecting end 62*b*. The inner surface thereof forms a locking opening 70 adapted for receiving the tab 66. In particular, the locking opening has a radial shoulder 70*a* adapted for receiving the shoulder 68*a* of the tab 66 in bearing contact.

Assembling the connecting ends 62*a* and 62*b* is done by elastically deforming the tab 66 for introducing the same in a longitudinal direction of assembly into the locking opening 70 until the shoulder 68*a* of the tab 66 is in surface bearing contact against the shoulder 70*a* of the opening 70, preventing movement of the tab away from the opening 70. Thus, assembling the ring 12 according to this variant does not require any tool.

Ring 12 also includes two flexible seals 71, each seal 71 being interposed between two connecting ends 62*a* and 62*b* ensuring the connection between the ring halves 44 and 44'.

Furthermore, connecting end 62*b* is provided with a through-opening 72 accessible from the outer surface thereof and opening into the assembly opening 70. This through-opening 72 allows for an unlocking tool to be introduced in order to elastically push back tab 66 and disassemble connecting ends 62*a* and 62*b*.

The metal coatings at the ends of the ring halves 44 and 44' are made so as to avoid the generation of field reinforcing regions, namely at the contact region of the ring halves therebetween.

Figure 10:
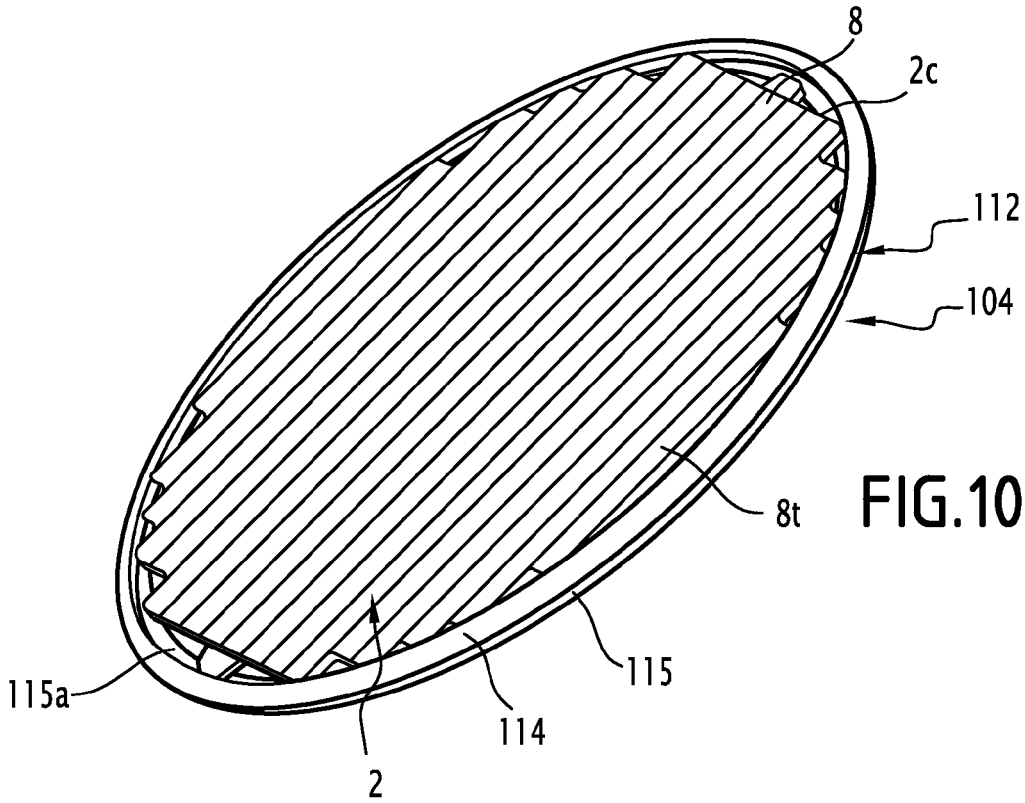
FIG. 10 is a perspective view of a unit according to a third embodiment of this invention.
Figure 11:
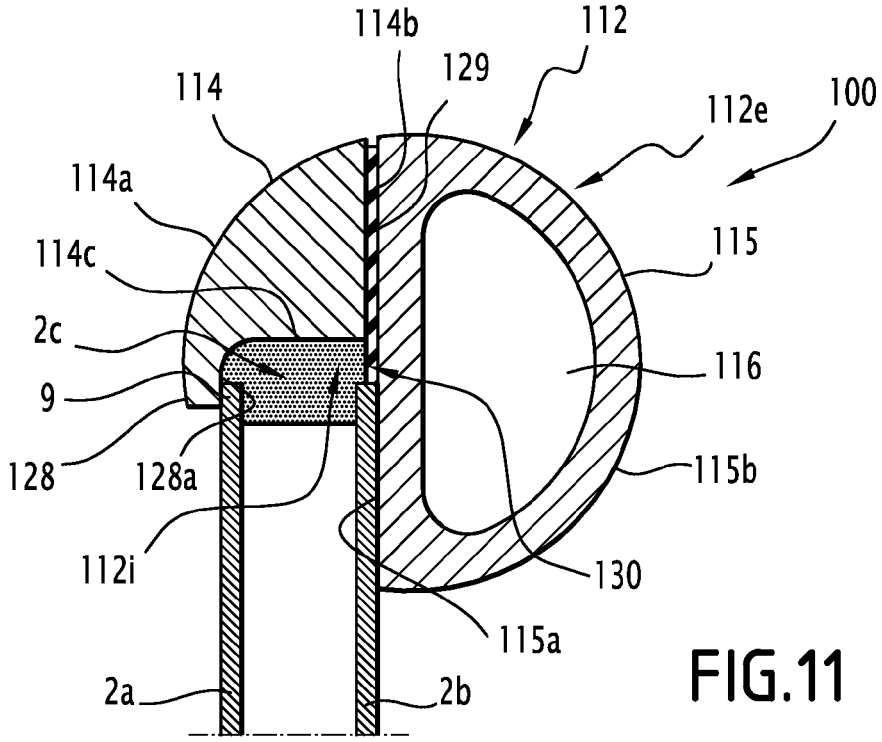
FIG. 11 is a view taken in section along a radian plane, of one part of the unit of FIG. 10.

In FIGS. 10 and 11, an antenna unit 100 according to a third embodiment of this invention is represented.

The device 100 includes an antenna 2, identical to the one described with reference to FIGS. 1 to 9, and a protecting device 104 comprising a protecting ring 112.

The ring 112 is different from ring 12 by the radial section and the assembly mode thereof.

Indeed, the ring 112 is made by assembling, along an assembly plane defined by the outline of the antenna 2, two annular elements 114, 115 having a substantially circular longitudinal section.

A first annular element 114, hereafter designated as a median annular element 114, surrounds the antenna 2 at right angles from the lateral outline 2*c* thereof. The median annular element 114 has a general revolving shape around the axis AA'. It has a radial section having the general shape of a quarter of a disk. The median annular element 114 includes an annular planar back longitudinal surface 114*b*. It also includes an annular transverse surface 114*c* orthogonal to the back surface 114*b* and arranged at right angles from the lateral outline 2*c* of the antenna 2, and a front surface 114*a* having a circular arc-shaped radial section.

Furthermore, the median annular element 114 has a flange 128 for holding the antenna 2, having a general revolving shape around axis AA', projecting from the front edge of the transverse surface 114*c* toward the center of the antenna 2. The flange 128 has a holding surface 128*a* oriented toward the back of the antenna 2, adapted to come into surface bearing contact against the front surface 2*a* of the antenna 2, in particular against the corners 9.

The distance d between the holding surface 128*a* and the back surface 114*b* is substantially equal to the thickness e of the antenna. Thus, when the flange 128 is in surface bearing contact against the front surface 2*a* of the antenna 2, the back surface 114*b* extends in the back plane of the antenna.

The second annular element 115, designated as the back annular element, is arranged on the back of the back plane of the antenna. The back annular element 115 has a general revolving shape around axis AA'.

The back annular element 115 includes a longitudinal front wall 115*a* plane, of annular shape, and a back wall 115*b* having a semicircular cross-section the radial section of the front wall 115*a* of which forms a diameter. The back annular element 115 thus forms a hollow tube 116, having a radial section in a generally semicircular shape.

The median 114 and back 115 annular elements substantially have the same outer diameter. The inner radius $R_{114}$ of the median annular element 114, defined as the distance between axis A-A' and transverse surface 114*c*, is slightly greater than the radius $R_2$ of the antenna 2.

E.g., the radius of the tube 116 is comprised between 1.2 and 3 times the thickness e of the antenna.

The front wall 115*a* of the back annular element 115 is adapted to come into surface bearing contact at right angles from the back surface 114*b* of the median annular element 114, and against a substantially annular outer portion of the back surface 2*b* of the antenna 2.

The ring 112 is assembled by positioning the median annular element 114 around the antenna 2, the transverse surface 114*c* thereof being arranged at right angles from the lateral outline 2*c* of the antenna 2, and the holding surface 128*a* being in surface bearing contact against the front surface 2*a* of the antenna 2, and by positioning the back annular element 115 behind the antenna 2, the front surface 115*a* thereof being at right angles from the back surface 114*b* of the median annular element 114, and against a substantially annular outer portion of the back surface 2*b* of the antenna 2. An annular seal 129 is interposed between the front 115*a* and back 114*b* surfaces. This seal 129 is meant to ensure contact between the annular elements 114, 115. It is made of an electrically conductive elastomer material.

E.g., the annular elements 114 and 115 are fastened to each other by screwing or clip-fastening.

The ring 112 is thus arranged around the antenna 2, contacting each of the projecting ridges 10. In particular, the corners 9 are in surface bearing contact against the surface 128*a* of the holding flange 128, and covered by this flange 128.

The holding surface 128*a*, the transverse surface 114*c* of the median annular element 114, and a portion of the front surface 115*a* of the back annular element 115, form an internal surface 112*i* of the ring 12, in electrical contact with the lateral outline 2*c*.

The transverse surface 114*c* and a portion of the front surface 115*a* delimit a bracket 130 receiving the antenna 2. The antenna 2 is maintained in a fixed position by being sandwiched between the front wall 115*a* and the holding flange 128.

The front surface 114*a* and the outer surface of the back wall 115*b* form an external surface 112*e* of the ring 112. This external surface is wide and rounded. It is thus devoid of reinforcing regions likely to cause peak effects.

As a variant, a flexible seal similar to flexible seal 14 is interposed between ring 112 and antenna 12.

The outer surface of the ring 112 is metallic. Equipotentializing of the antenna 2 and the ring 112 is thus ensured by the electrical contact between the holding flange 128 and the corners 9 of the antenna 2.

The ring 112 is made of a light-weight and rigid material. The outer surface of each annular element 114, 115 is metallic.

Advantageously, each ring half 114, 115 of the ring 112 is made as described before for the ring halves of the ring 12.

Thus made, the antenna unit according to the invention allows for the risks of lightning attachment to be avoided, and thus for lightning resistance of an aircraft incorporating the device to be improved over antenna 2 only. This improvement of lightning resistance is moreover made without having to modify the arrangement of the front tip of the aircraft, i.e. without having to modify the position of the antenna in this front tip or increase the radome.

Indeed, the antenna unit according to the invention does not include any tip or salient angle forming a reinforcing region of the electric field. Rather, the external surface of the ring is wide and rounded, allowing for the static field at the periphery of the antenna to be reduced.

This static field reduction is all the more important as the surface area of the external surface of the ring is large. Indeed, the field may then spread over a larger surface.

According to this invention, and in accordance with the embodiments described, the ring has a median portion, surrounding the antenna 2 at right angles from the lateral outline 2*c* thereof, and a back portion, arranged on the back of the antenna 2. Only the holding flanges extend on the front of the front plane of the antenna 2. Such a structure of the ring allows for a large external surface of the ring to be developed while minimizing disturbances of the radiation pattern of the antenna. Indeed, this external surface develops mainly on the back of the antenna 2.

Making the ring of a light-weight material allows for minimizing the increase of inertia of the antenna due to the ring. This light weight is namely enhanced by the hollow tube shape of the ring. Also, the strength of this material allows for deformations of the ring to be limited.

As a variant, the ring 12 or 112 is entirely made of metal.

It should be appreciated that the sample embodiments presented herein are non restrictive.

Namely, according to one embodiment, the ring is integrated into the antenna when it is manufactured, so that assembly of the ring around the antenna can be avoided. For example, the ring can be made integrally with the antenna.

Furthermore, the technical characteristics of the embodiments and variants mentioned above can be combined with each other.

While the foregoing is directed to embodiments of the present invention, other and further embodiments of the invention may be devised without departing from the basic scope thereof, and the scope thereof is determined by the claims that follow.

The invention claimed is:

1. An antenna unit comprising an antenna having a radiating front surface, a back surface and a lateral outline having at least one electric field reinforcing region, said antenna unit being characterized in that it further comprises a protecting device for protecting the antenna from lightning, having an internal surface at least partially capping the lateral outline of said antenna by being in electrical contact with said lateral outline, said internal surface covering the at least one electric field reinforcing region, said protecting device having a curved external surface opposite said internal surface, said protecting device including a circumferential median portion placed opposite said lateral outline, and a back portion, arranged on the back of said back surface, said median and back portions forming a housing receiving the antenna.

2. The antenna unit according to claim 1, wherein said antenna is a disk-like planar antenna, said protecting device advantageously having an annular shape.

3. The antenna unit according to claim 1, wherein said electric field reinforcing region is an angular part of said lateral outline.

4. The antenna unit according to claim 1, wherein said protecting device further includes a holding flange, arranged on the front of the front surface of the antenna, said back portion and said holding flange gripping the antenna inside said protecting device.

5. The antenna unit according to claim 4, wherein said back portion includes a longitudinal bearing face bearing against the back surface of the antenna, said median portion includes a transverse bearing face bearing against said lateral outline, and said holding flange includes a holding face in surface bearing contact against the front surface of the antenna, said internal surface being formed by said longitudinal bearing face, said transverse bearing face, and said holding face.

6. The antenna unit according to claim 4, wherein said holding flange is in electrical contact with at least one part of the field reinforcing regions of said antenna.

7. The antenna unit according to claim 1, wherein said protecting device includes a rigid body and a deformable fastening seal, partially interposed between said body and said antenna.

8. The antenna unit according to claim 1, wherein said protecting device includes a rigid body made integrally, having an internal surface at least partially capping the lateral outline of said antenna by being in electrical contact with said lateral outline, said internal surface covering the at least one electric field reinforcing region, said rigid body having a curved external surface opposite said internal surface, and wherein said rigid body includes engaging means for engaging said antenna in said rigid body.

9. The antenna unit according to claim 8, wherein said rigid body includes locking means for locking the position of said antenna with respect to said protecting device.

10. The antenna unit according to claim 1, wherein said protecting device has several elements assembled along a radial plane of said antenna.

11. The antenna unit according to claim 1, wherein said protecting device has at least two elements assembled on either side of the lateral outline of the antenna.

12. The antenna unit according to claim 1, wherein said internal surface and said curved external surface are electrically conductive, advantageously metal-coated.

13. The antenna unit according to claim 1, wherein said protecting device is formed from an electrically insulating material at least partially covered by a metal coating.

14. The antenna unit according to according to claim 1, wherein said antenna has a plurality of slots.

* * * * *